United States Patent [19]

Crane

[11] 3,989,140

[45] Nov. 2, 1976

[54] APPARATUS FOR UNITIZING STACKED PRODUCT CONTAINERS FOR SHIPMENT

[75] Inventor: Walton B. Crane, Sherman Oaks, Calif.

[73] Assignee: A & E Plastik Pak Co., Inc., City of Industry, Calif.

[22] Filed: Mar. 3, 1975

[21] Appl. No.: 554,656

[52] U.S. Cl. ..... 206/386; 206/509; 206/526; 206/821; 214/10.5 R

[51] Int. Cl.[2] ..... B65D 21/02

[58] Field of Search ..... 206/386, 442, 503, 509, 206/526, 821; 211/133, 177; 214/10.5 R; 312/107–108, 111

[56] References Cited

UNITED STATES PATENTS

| | | | |
|---|---|---|---|
| 2,187,355 | 1/1940 | MacManus | 206/821 X |
| 2,774,474 | 12/1956 | Phillips | 206/386 X |
| 3,334,738 | 8/1967 | Crane | 206/386 |

*Primary Examiner*—Steven E. Lipman
*Attorney, Agent, or Firm*—Forrest J. Lilly

[57] ABSTRACT

The invention provides cleats or bars for interlocking produce lug boxes at the top tier of multiple tier columns of such boxes arranged on a pallet in a unitized stack. The lug boxes have rectangular plastic frames at their ends, surmounted by spacers, and the invention provides cleats or bars which clamp to these spacers at the top of the stack. The end frames of the containers engage end-frame to end-frame in the stack, and are provided with interlocking elements which prevent lateral shifting of individual containers. In combination with the use of these interlocking elements, the clamping bars at the top provide an especially well integrated stack of containers. In addition, certain binding tapes are used, and these interengage with guides and recesses in the end frames and locking bars to unitize and stabilize the stack. The clamping bars also provide flat platforms on which can be mounted a second pallet supporting a second stack of containers.

3 Claims, 7 Drawing Figures

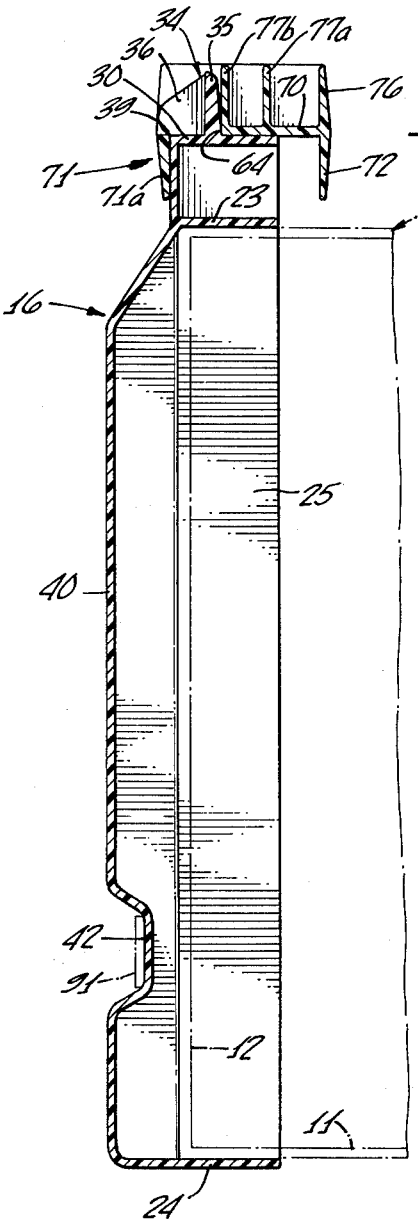
FIG. 5.
FIG. 7.
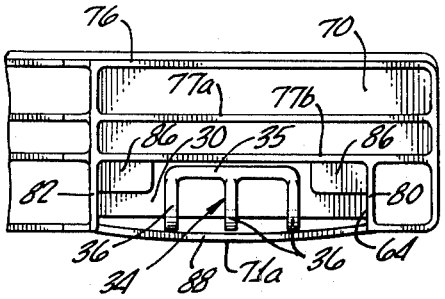
FIG. 6.
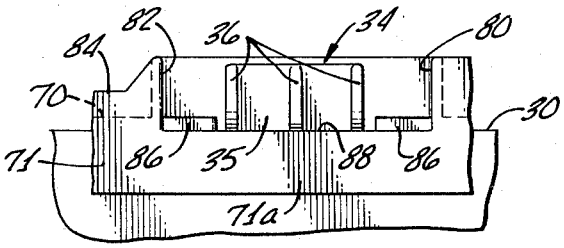

APPARATUS FOR UNITIZING STACKED PRODUCT CONTAINERS FOR SHIPMENT

FIELD OF THE INVENTION

This invention relates generally to the field of unitizing filled produce containers arranged in horizontal groups which are stacked as tiers on a pallet for security and convenience in warehousing or shipment. The containers chiefly in mind are of the "lug" box type, though fabricated from board such as corrugated paperboard, equipped with reinforcing end frames which may be of a suitable injection molded plastics material, or a thin metal pressed into shape.

The particular produce containers for which the present invention has been especially contrived are comprised of a rectangular, generally paperboard carton, fitted at opposite ends with reinforcing plastic end frames, which are strong and to engage, enough toengage, end frame to end frame, and so bear the entire load, when a number of the containers are stacked on a supporting pallet. Conventionally, a number of the cartons, say a group of six, in two adjacent rows of three each, may be laid down on the pallet, another group of six laid down on the first group, as a second tier or layer, and so on to a relatively high stack of, typically, around a dozen tiers. The containers may then be strapped tightly together and to the pallet. However, without more, the containers may shift relatively to one another, and additional utilizing means is needed in order to secure the cartons in the stacks from lateral shift.

A general purpose and accomplishment of the invention is accordingly the provision of a novel and more effective unitizing system by which the containers may be mechanically releasably interlocked to adjacent containers, so as to provide integrated sub-groups, and with the sub-groups so stacked and tied that a stable stack of pallet and containers, made of up of about 66 of the containers, is achieved. Additionally, it is a purpose to make suitable provisions by which a second or even a third pallet and stack may be stacked on the first or ground stack in warehousing.

BRIEF DESCRIPTION OF THE INVENTION

The invention contemplates that, preferably, each tier of containers will comprise two adjacent rows of containers, with three containers in each row; and that approximately 11 of such tiers will be stacked on and fastened to a pallet. At the top tier, the containers in each row of three are interlocked along at least their outside top end edges by clamping bars which lock to certain formations on the aforementioned end frames. The locking bars can be used, or omitted, along the inside or meeting end frames of the two adjacent rows.

The preferred plastic end frames are formed, near each end, with vertical columns which project somewhat forwardly from the principal outside vertical plane of the end frames, and which are formed with horizontal indentations to receive and position horizontal binding straps. I have found that a stack of containers, of optimum stability, with six containers in each tier, is achieved if the stack is 11 tiers high, and such a binding strap is positioned on the stack at the second and eighth tiers, counting up from the bottom; and if two vertical straps are wrapped around the aforementioned end-framesupporting locking bars at the junctures between adjacent containers of each row of three.

At these locations, the locking bars have vertical indentations to receive the vertical straps where the latter turn horizontally over the top of the stack.

BRIEF DESCRIPTION OF THE DRAWINGS

FIG. 5 is a section taken on line 5—5 of FIG. 4;

FIG. 6 is an elevational view looking in the direction of the arrow 6 in FIG. 4; and FIG. 7 is a fragmentary view looking in the direction of the arrow 7 in FIG. 4, with the locking bar forced part-way down onto the clamp prong below.

DESCRIPTION OF THE ILLUSTRATIVE EMBODIMENT

The basic container of the invention is a plastic and paper or other board substitute for the familiar wooden lug box, now fading from its former virtually competition-free status by reason of shortage and price of wood. The preferred container is of the size of the old wooden lug box, but is now generally composed of corrugated paperboard, braced and stiffened at the ends by injection molded plastic end frames. These end frames are composed of copolanar side and end flanges adapted to overlap marginal edge strips of the end walls of the paperboard container, together with "perpendicular" flanges, turned at right angles from the outer margins of the coplanar flanges, so as to receive and/or lie adjacent marginal end portions of the paperboard containers. The paperboard containers are peferably provided with lid members hinged along the longitudinal upper edges of the side walls thereof. The tops of the plastic end frames are formed with elevated stacking platforms, each with a vertically projecting positioning tongue, engageable in an aperture in the lower perpendicular flange of the container immediately above. A basic form of such a container is disclosed in my co-pending patent application Ser. No. 307,962, filed Nov. 20, 1972, now U.S. Pat. No. 3,878,980. An improved form of such a container is disclosed in my co-pending application Ser. No. 529,617, filed Dec. 5, 1974. Reference to said applications for a more complete understanding of the lug boxes referred to herein is here made, and the subject matter of said applications is incorporated herein by this reference.

Figure 1:
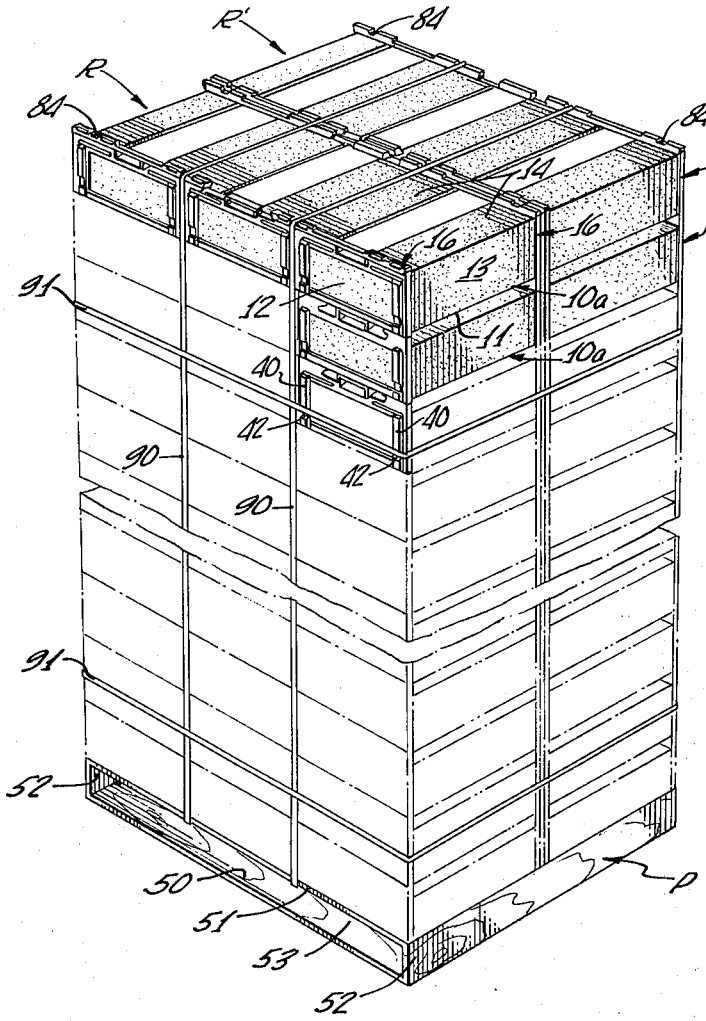
FIG. 1 is a perspective view of a stack of lug boxes secured to one another by the means provided by the invention.
Figure 2:
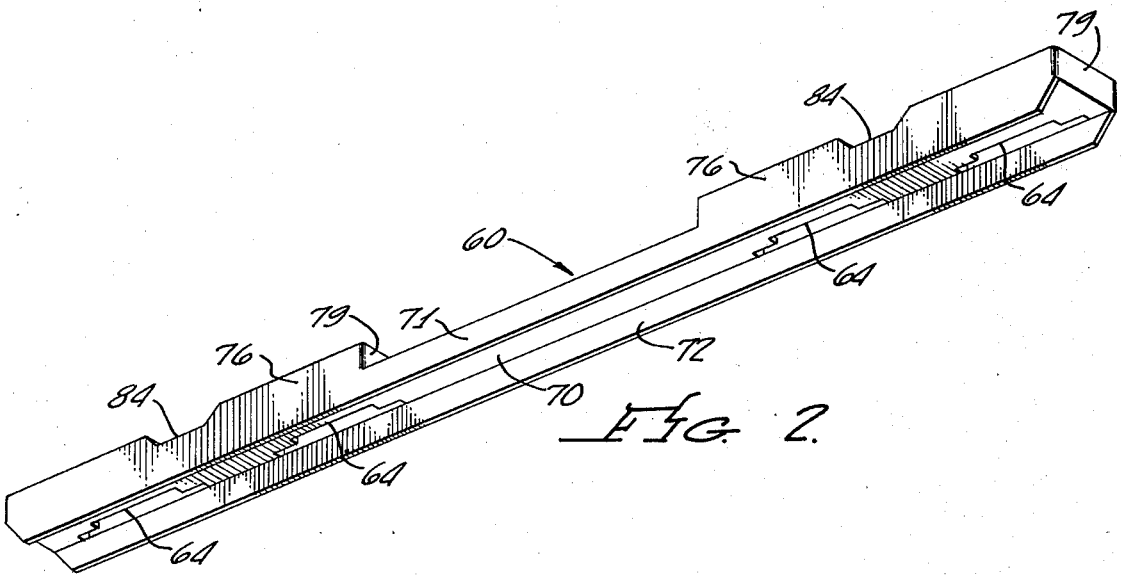
FIG. 2 is a perspective view of a locking bar used to interlock end frames of lug boxes at the top tier of a stack of such boxes.

Turning now to the drawings, FIG. 1 shows a six column stack of the containers 10, each preferably eleven tiers tall, and each tier comprised of two rows of three containers arranged side by side.

Each container comprises a paperboard box **10*a* which is generally rectangular, having been erected on suitable score lines from a single blank of corrugated paper or other suitable board stock, and each comprised of a bottom 11, ends 12, multiple ply sides 13, and a pair of lids 14 hinged to the upper longitudinal edges of sides 13. Such a box is conventional. The ends of this box 10*a* are fitted with light but stiff rectangular end frames 16, composed preferably of suitable injection molded plastics material. These end frames 16 complete the container 10**.

The end frames 16 have generally coplanar upper, lower, and vertical edge flanges 20, 21 and 22, respectively, and upper, lower and vertical perpendicular flanges 23, 24 and 25, respectively, projecting perpendicularly from said edge flanges, from the outer edges of the latter.

The perpendicular flanges fit snugly on over limited end portions of paperboard box 10*a*, as fragmentary represented in phantom lines in FIG. 5, the lids 14 being understood to be cut back at their end edges so as to fit between the end frames 16, and thus remain outside thereof.

Centrally located on and extending vertically upward from the substantially horizontal upwardly facing surface on the upper side of the upper perpendicular flange 23 of each end frame is an integral spacer 28 whose top forms a substantially horizontal, elevated, stacking surface, and which is cored out to form a recess 29 that adapts the spacer 28 to serve as a handle.

Occupying opposite end portions of the flange 23, and, spaced from opposite ends of the spacer 28, are elevated spacers 30, also formed integrally with the end frame, and affording flat horizontal tops forming substantially horizontal stacking surfaces, preferably coplanar with the top of the handle member. In practice, the top of the elevated member 28 may not necessarily function as stacking surface, and thus can be spaced somewhat below the level of the stacking surfaces on spacers 30 if desired. The spacers 30 are cored out as seen in FIG. 5.

When a given container is stacked on a container immediately below, a substantially flat and horizontal surface on the lower side of the lower perpendicular flange 24 will be understood to engage and rest upon the end spacers 30, and on the central spacer 28 as well if the latter is coplanar therewith.

The weight of a stack of containers is thus transferred through the plastic end frames rather than through any paperboard portions of the latter.

Projecting upwardly from each of the end spacers 30 is a vertical positioning prong 34, comprised of an upright back wall 35, and formed with spaced transverse walls 36, sloping downwardly and outwardly (relative to the corresponding end of the container) at a preferred angle of about 45°, and thence rounded through vertical and finally back inwardly to a junction point 39 with the outer edge of the spacer 30. Rounded portions of the walls 36 thus overhang the outermost edges of the spacers 30.

The inner edges of the vertical coplanar flanges 22 merge with or are completed by integral vertical column members 40, displaced outwardly from the coplanar flanges 20, 21 and 22. These column portions have transverse indentations 42, to receive and position certain ties to be described presently.

Referring now again to FIG. 1, six columns of containers 10 are stacked on a pallet P, the containers engaging end frame to end frame, with the undersides of the lower perpendicular flanges 24 engaging the upper surfaces of the spacers 30 of the container immediately below in each case. The pallet P is shown to comprise a lower platform 50, an upper platform 51, and edge walls 52, the pallet having a through passage or tunnel 53 between the lower and upper platforms and between edge walls 52. Six of the containers make up a tier composed of two immediately adjacent rows R and R′ of three containers each, and such a tier substantially fits the top of the pallet, and rests thereon. The remaining tiers are stacked above, as represented.

Figure 3:
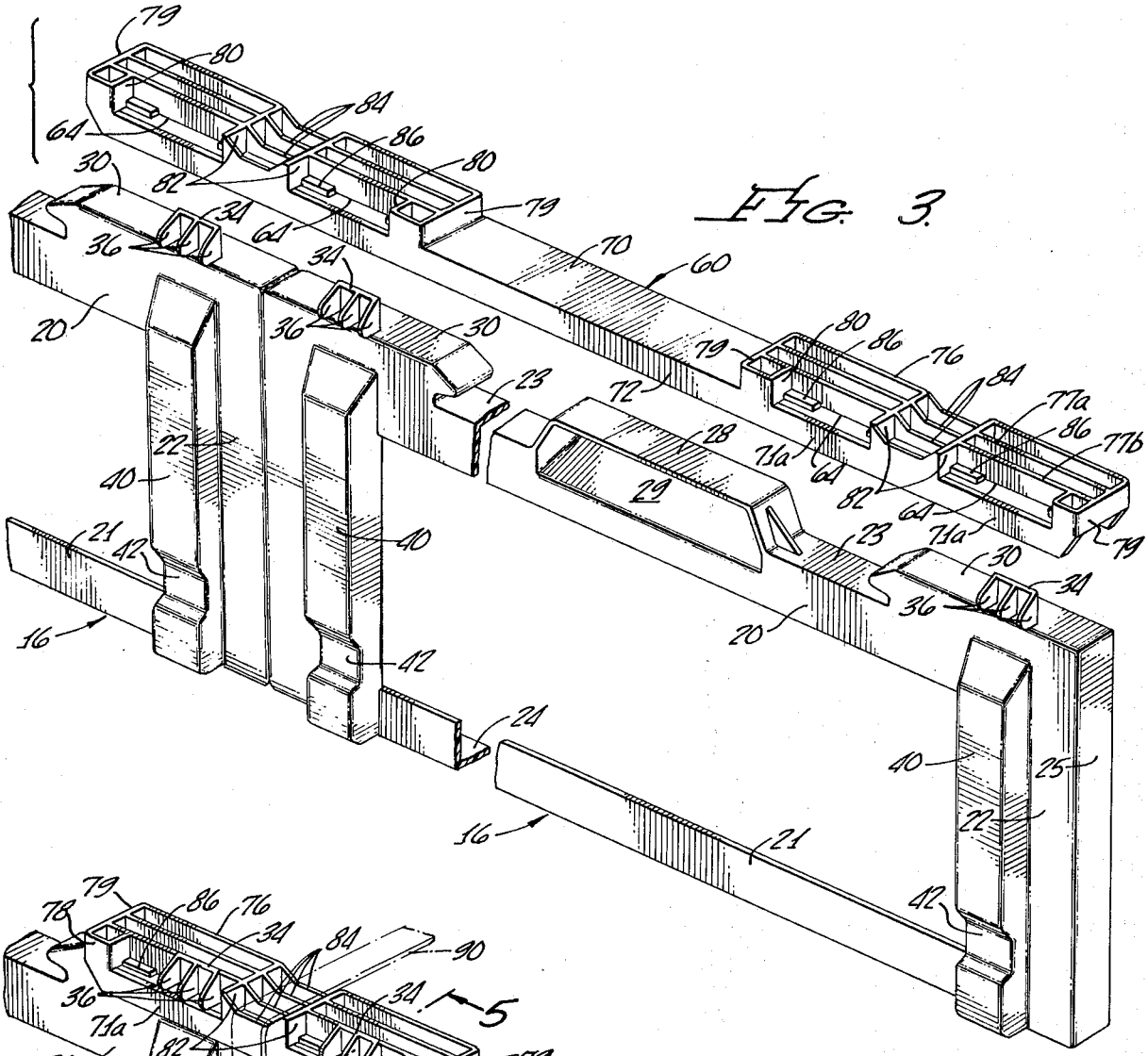
FIG. 3 is an exploded perspective view, showing adjacent end frames of lug boxes at the top tier of the stack, and showing thereover locking bars in accordance with the invention, not yet fitted down onto the end frames.
Figure 4:
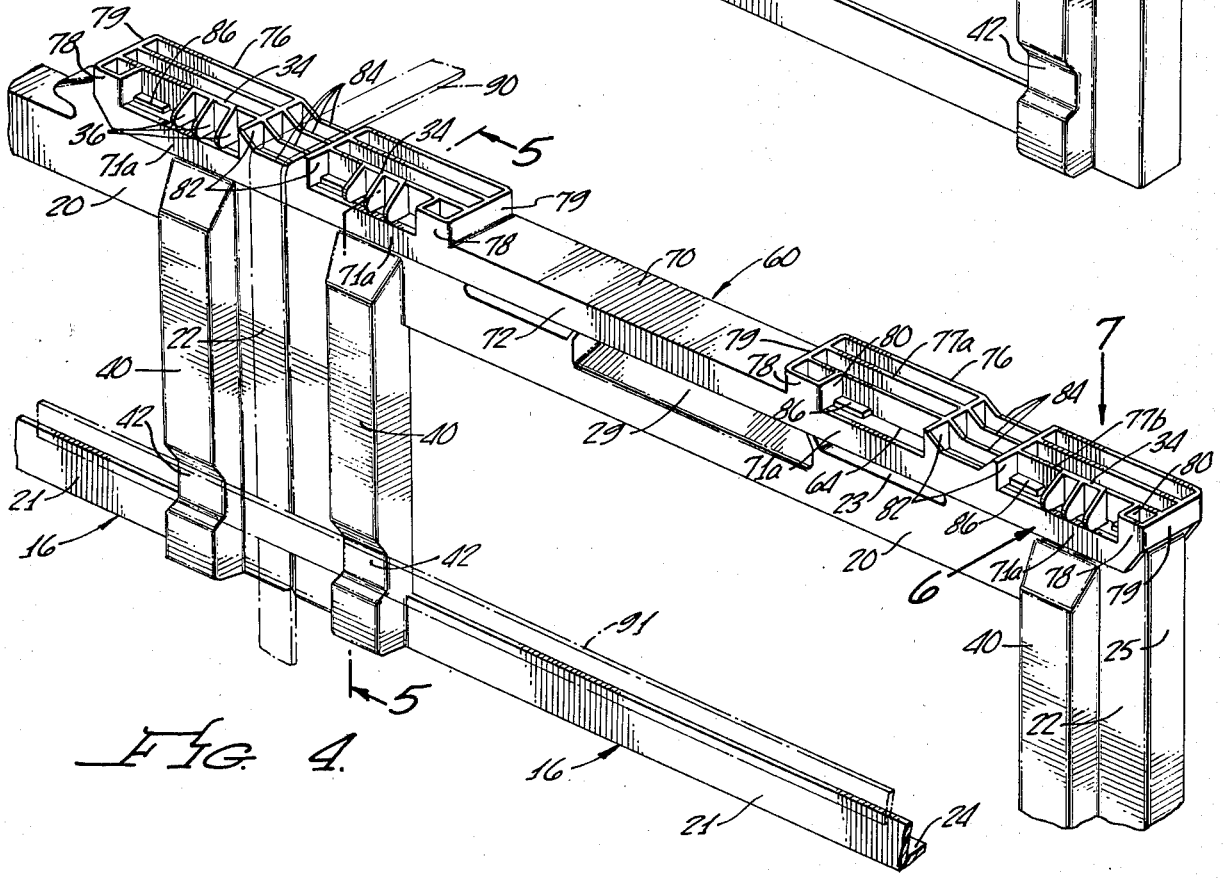
FIG. 4 is a view similar to FIG. 3, but showing the locking bars and ties in place on the end frames.

FIGS. 3 and 4 are fragmentary enlarged views of the near end frames of the two nearest containers of container row R taken from FIG. 1, FIG. 3 being an exploded view prior to installation of a clamp bar 60, and FIG. 4 showing the clamp bar 60 installed.

The clamp bars 60 are preferably composed of a suitable injection molded plastics material, and are adapted to be mounted on tops of selected end frames spacers 30 of the uppermost tier, and to clamp to the corresponding positioning prongs 34 of adjacent containers to releasably lock such containers together. A given clamp bar 60 is dimensioned to fit down on top of an outside corner spacer 30 of an outside end frame 16 of a row R of three such frames, and to reach across the joint between that outside end frame and the adjacent middle end frame to overlie and fit down on the next adjacent corner spacer 30 of said middle end frame. Each end of the bar 60 is provided with two longitudinally spaced apertures 64 to receive with a tight fit and releasably clamp to the two adjacent prongs 34 of the middle and outside end frames, and to reach and receive and clmap also to the remaining prong 34 of the outside end frame. For convenience and symmetry, I prefer to provide double apertures 64 at each end of the bar 60, even though one of these has no function in the situation depicted in FIG. 4. By having the opposite apertured end portions of the bar identical, however, the installation is greatly facilitated, since the operator then need give no attention to end-for-end positioning of the bar in applying it.

Each bar 60, considered in more detail, comprises first, a longitudinal horizontal web 70, and flanges 71 and 72 depending from its opposite edges. The web 70 is adapted to seat on the horizontal upper surfaces of the spacers 30, spanning both spacers of the end frame of the first outside container of a row, such as R, and the near spacer 30 of the end frame of the middle container of the row (FIGS. 3 and 4). The bar has at each of its opposite ends the aforementioned pair of apertures 64, which receive and clamp to the corresponding prongs 34. As will be noted, there is no prong 34 to be received in the innermost aperture 64 at the outermost end of the bar, i.e., the end that overlies the outside spacer 30. Thus, the bar is double-ended, and can be applied hurriedly without preliminary inspection to see that it is oriented end-for-end to correspond to the three prongs 34 with which it is to engage. Also, there is the evident advantage that only one style bar need be made and stocked.

A network of upstanding bracing flanges formed integrally with the web 70 of the bar surrounds the two apertures 64 at each end of the bar. These include a longitudinal rear edge flange 76, two parallel flanges or ribs 77*a* and 77*b* running longitudinally along the center of the bar, and front longitudinal flanges 78 interrupted by apertures 64. The network includes transverse flanges 79 at the extremities of the longitudinal flanges, transverse flanges 80 at the remote extremities of the apertures 64, and a pair of transverse flanges 82 between each pair of apertures 64. These transverse flanges are spaced apart, as shown, and the segments of the longitudinal flanges therebetween have indentations 84 therebetween to receive and position binding straps to be described presently.

The aforementioned apertures 64 will be seen to be formed in the webs 70, being defined, when the bar is seen in plan, by the adjacent surfaces of flanges 77*b*, and at opposite ends by flanges 80 and 82. Rectangular portions or elements 86 of web 70, in the corners between flanges 77*b* and flanges 80 and 82, respectively, afford the apertures 64 with a "shouldered" shape, the distance between the opposed ends of the flange portions 70 being great enough to freely or just nicely receive the prongs 34, and the length of apertures 64 beyond or outside the ends of the flange elements 86 being sufficient that the portion 71*a* of the web 71 between walls 80 and 82 is long enough to be capable of a degree of lateral resilient flexure (FIG. 7). Note should be taken that the upper edge 88 of web portion 71*a* is formed to lie in the horizontal plane of the underside of web 70 (see FIG. 5).

To apply a bar 60 to a pair of adjacent end and middle containers of a six container top tier of a six column stack (FIG. 1), the bar is first positioned over the near and middle container end frames (FIG. 3), and the bar lowered and forced down so that apertures 64 therein engage with the locking prongs 34. The sloping edges of the prongs engage the somewhat flexible, resilient flange straps 71*a*, and the bars are then forced down, so as to stretch these straps sufficiently laterally outward for the "humps" toward the bottoms of the slopes to pass first inside (FIG. 7), and then above the straps to the final engaged position shown in FIG. 5. The straps 71*a* resiliently contract to the position of FIG. 5, and thus become firmly, but releasably, locked to the spacers 30 (FIGS. 4, 5 and 6).

The preferred practice of the invention involves application of the invention to a double column stack of containers as in FIG. 1, where the containers are arranged in two laterally adjacent rows R and R′ of three containers each. These, stacked vertically, make up two sub-columns of three containers at each tier. Corresponding containers of the two rows of three abut end-to-end down a center line, so that there are six containers in a tier. The stack of tiers on the pallet is preferably eleven tiers tall, affording an optimized situation for stability. Two of the locking bars are installed as heretofore described on the aligned outermost end frames of the containers of each of the rows R and R′, the expression outermost referring to those end frames which face outwardly from the overall stack, as distinguished from those at the center line of the stack. Locking bars are also shown in FIG. 1 at the innermost ends of the containers, i.e., those at the center line of the stack, between rows R and R′. However, experience has shown that for security, it is generally adequate if the bars along the center line are omitted.

The bars 60 having been attached, vertical and horizontal straps 90 and 91 are wrapped in two directions about the overall stack, and fastened in any conventional manner. The straps should of course be strong, and may be composed of metal, or preferably plastic such as is now well known and on the market.

Generally, two of the straps 90 are used. They are wrapped vertically or longitudinally, about the stack and underneath the top platform 51 of the pallet P. These straps 90 are in the planes of the junctions between the middle and end containers of the tiers, and thus go between the columns 40 of adjacent containers, and wrap over the top of the stack, i.e., going over and through the notches 84 of the clamping bars 60 clamped to the container end frames 16 on the top tier containers. These straps are tautened and clamped by any conventional clamping device not shown. For still greater security, similar vertical straps, not shown, may be used near the sides of the stacks, guided by the outermost notches 84 of the bars 60.

In addition, horizontal straps 91, utilizing the strap notches or indentations 42 in the end frame columns 40 as positioning means, are used, these also being tautened and clamped in place by suitable clamping means.

In the preferred arrangement, I use two of the straps 91, going around the second and ninth tier of an eleven tier stack. I have found that the use of a strap at the second tier restrains a toppling tendency for an eleven tier stack, and that a strap at the ninth tier then steadies the upper part of the stack, both to optimized degree. Some variance is of course permissible, particularly if the stack should be made taller than eleven tiers.

The various flange formations such as 76, 77*a*, 77*b*, 79, etc. on the interlocking clamping bars 60 form a horizontal plane which can function as a flat supporting means for the next pallet up, used particularly in warehousing to carry a second stack, etc. These flanges thus define a horizontal support plane; and the positioning prongs 34 are then terminated at, or preferably just below, this horizontal plane. Without the intervening bars, it would of course be very awkward to stack on a second pallet because of interference of such a pallet with these prongs.

In a modification, not shown, the locking bars are only long enough to span the adjacent elevated spacers 30 of two adjacent containers, thus using only the left hand end portion of the bar 60 of FIGS. 3 and 4. In other words, the portion of the bar 60 forwardly or to the right of the flange 79 at the left hand end portion of the bar is simply omitted. Some bracing stiffness may thus be lost, but the device in this curtailed form is still perfectly operative in some applications.

It will of course be understood that the invention has been disclosed in a present preferred embodiment, and that numerous changes may be made in design, structure and arrangement without departing from the spirit and scope of the invention as defined in the appended claims.

What is claimed is:

1. A unitized six column stack of produce containers on a pallet, including two adjacent multiple-tiered sub-columns of containers, in tiers each comprising two parallel, adjacent rows of three containers each, side-to-side, and the stack comprising two sub-columns, with the containers in the two sub-columns positioned end-to-end, each container includng generally rectangular bottom, side and end walls, and rigid, generally rectangular reinforcing and stacking end frames secured to opposite ends thereof, said end frames each including a generally horizontally extending top member having upwardly facing stacking surfaces at opposite end regions thereof for the engagement with the end frame of the container immediately above, positioning prongs projecting upward above the stacking surfaces, the end frame of the container immediately above having apertures for the reception of said positioning prongs, releasable locking bars extending across the junctions between the outwardly facing end frames of the top containers of the unitized stack of containers, said locking bars being applicable downwardly to said top end frame members and having apertures spaced apart and fitted for relatively tight-fitting reception of said prongs to releasably secure said prongs to said top end frame members.

2. The subject matter of claim 1, wherein said bars have strap guiding notches in the regions of the junctions between containers, and binding straps wrapped on said column of containers and pallet in spaced vertical planes at the junctions between adjacent containers, said straps engaging in said strap guiding notches.

3. The subject matter of claim 2, including also outward protuberances on said end frames, intersected by horizontal strap guiding notches, and binding straps wrapped around said column of containers at selected levels, said straps engaging in said last-mentioned strap guiding notches.

* * * * *